US009604112B2

(12) United States Patent
Gilman et al.

(10) Patent No.: US 9,604,112 B2
(45) Date of Patent: Mar. 28, 2017

(54) FEEDING NET

(71) Applicant: Marty Gilman, Inc., Gilman, CT (US)

(72) Inventors: Neil Gilman, Gilman, CT (US); Craig Wanner, Gilman, CT (US)

(73) Assignee: MARTY GILMAN, INC., Gilman, CT (US)

( * ) Notice: Subject to any disclaimer, the term of this patent is extended or adjusted under 35 U.S.C. 154(b) by 0 days.

(21) Appl. No.: 14/591,179

(22) Filed: Jan. 7, 2015

(65) Prior Publication Data

US 2015/0190696 A1 Jul. 9, 2015

Related U.S. Application Data

(60) Provisional application No. 61/924,852, filed on Jan. 8, 2014.

(51) Int. Cl.

| | |
|---|---|
| ***A63B 63/00*** | (2006.01) |
| ***A63B 69/00*** | (2006.01) |
| ***A63B 63/08*** | (2006.01) |
| *A63B 102/14* | (2015.01) |
| *A63B 47/02* | (2006.01) |
| *A63B 71/02* | (2006.01) |
| *A63B 71/06* | (2006.01) |

(52) U.S. Cl.

CPC ..... *A63B 69/00* (2013.01); *A63B 63/00* (2013.01); *A63B 63/08* (2013.01); *A63B 47/02* (2013.01); *A63B 2063/001* (2013.01); *A63B 2071/025* (2013.01); *A63B 2071/0694* (2013.01); *A63B 2102/14* (2015.10)

(58) Field of Classification Search

CPC ..... A63B 69/00; A63B 63/08

USPC ..... 473/513, 510, 512, 478, 448, 410, 402, 473/477, 479; D21/705; 273/410, 273/401–402

See application file for complete search history.

(56) References Cited

U.S. PATENT DOCUMENTS

| | | | | | |
|---|---|---|---|---|---|
| 2,895,737 | A | * | 7/1959 | Blees | A63B 63/00 473/197 |
| 3,580,578 | A | * | 5/1971 | McCarthy | A63B 67/002 273/401 |
| 3,918,711 | A | * | 11/1975 | Zak | A63B 69/38 473/195 |
| 4,492,380 | A | * | 1/1985 | Saytar | A63B 63/00 273/400 |

(Continued)

OTHER PUBLICATIONS

Webpage download, Amazon2011, 2011, www.amazon.com/Caster-Classics%C2%AE-Locking-Profile-Casters/dp/B004KZAR68, 1 page.*

*Primary Examiner* — Gene Kim
*Assistant Examiner* — M Chambers
(74) *Attorney, Agent, or Firm* — Crawford Maunu PLLC

(57) ABSTRACT

The disclosure relates to a feeding net including a backstop net affixed to a frame connected to a base that may be mounted on wheels. The net includes a plurality of drop pockets which can catch lacrosse ball. The drop pockets can be numbered sequentially with indicia, as desired. The wheeled base can include a removable plastic drop bucket for retaining lacrosse balls that are not caught inside the drop pocket or that bounce off the backstop net. The wheeled base can also include an integral deflector shield situated across the backstop net. The deflector shields helps ensure that balls that bounce of the net can be deflected into the drop bucket.

14 Claims, 1 Drawing Sheet

(56) References Cited

U.S. PATENT DOCUMENTS

| | | | | | |
|---|---|---|---|---|---|
| 5,000,461 | A * | 3/1991 | Borazjani | A63B 63/00 | 273/400 |
| 5,217,230 | A * | 6/1993 | Judd | A63B 63/00 | 273/398 |
| 5,722,905 | A * | 3/1998 | Bidelman | A63B 71/022 | 273/400 |
| 6,659,893 | B1 * | 12/2003 | Campbell | A63B 69/0095 | 473/459 |
| 6,955,615 | B1 * | 10/2005 | Cavell | A63B 69/0002 | 473/451 |
| 7,056,241 | B1 * | 6/2006 | Ishino | A63B 47/025 | 473/459 |
| 2002/0049103 | A1 * | 4/2002 | Treihart | A63B 63/00 | 473/454 |
| 2003/0073520 | A1 * | 4/2003 | Saludo | A63B 71/0045 | 473/474 |
| 2015/0190696 | A1 * | 7/2015 | Gilman | A63B 69/00 | 473/446 |

* cited by examiner

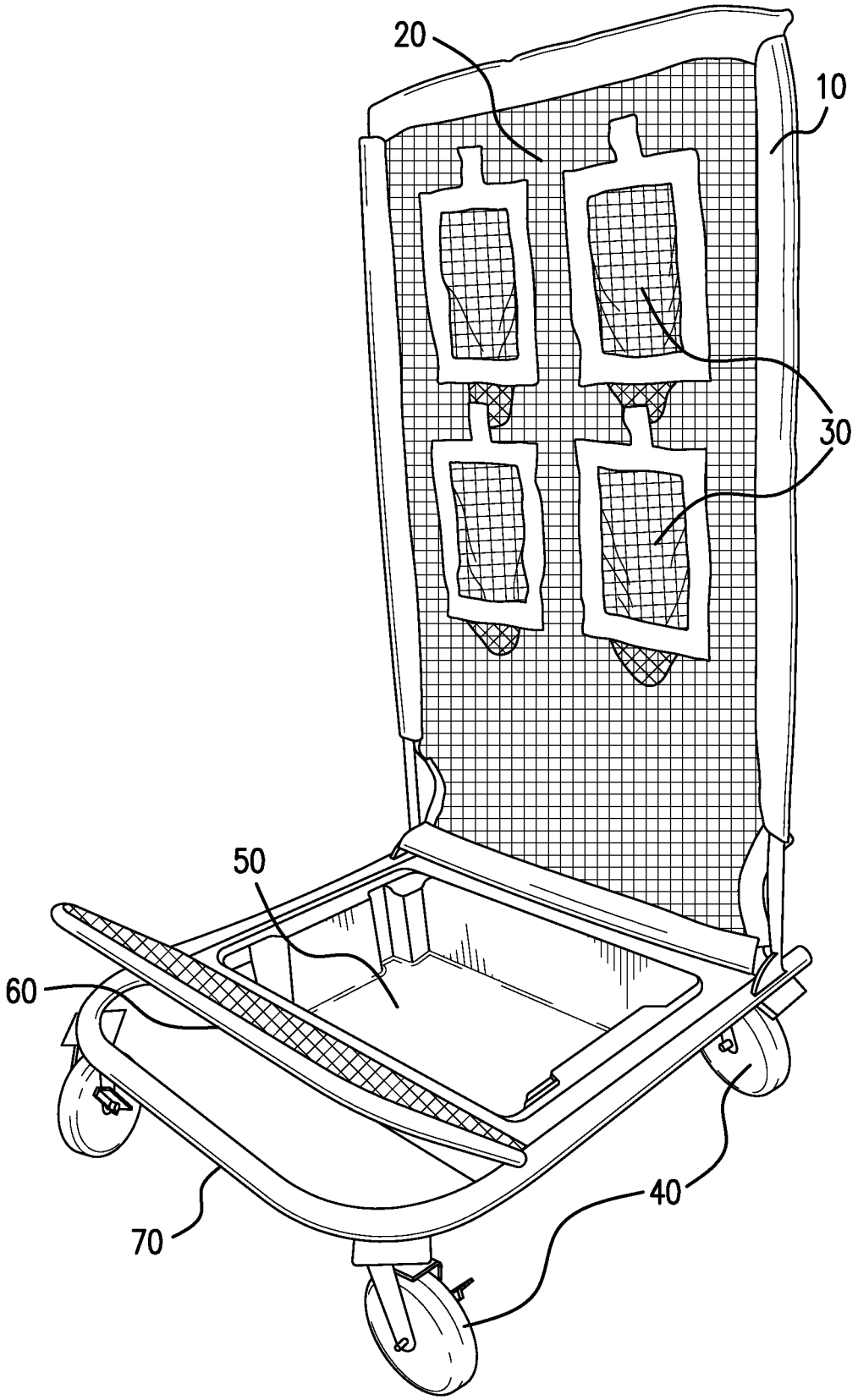
20
10
30
50
60
40
70

FEEDING NET

RELATED APPLICATIONS

This application claims priority to U.S. Provisional Application No. 61/924,852, filed Jan. 8, 2014, the disclosure and teachings of which are incorporated herein by reference.

FIELD OF THE DISCLOSURE

The present disclosure relates to sports equipment used in the sport of Lacrosse.

BACKGROUND OF THE DISCLOSURE

Lacrosse is a contact team sport which utilizes a small rubber ball and a long-handled stick called a crosse or lacrosse stick. Lacrosse can be played by both men and women and all versions of the game require players to wear padding such as shoulder pads, gloves, helmets, elbow pads, cup, and sometimes rib guards. Some players wear protective face masks. The objective of the game is for a player to score by shooting the ball into an opponent's goal. The lacrosse stick is used to catch, carry, and pass the ball. Other players must keep the opposing team from scoring and attempt to gain the ball through the use of stick checking or poke checking (a defensive technique where a player uses his stick to stop an opposing player), body contact or positioning.

Lacrosse can be played by a team of varying numbers, each carrying a lacrosse stick. Most teams have at least one attack or attack man, one defender or defenseman and at least one midfielder. Attackers are players who are located on the offensive side of the field and focus on scoring. Defenders are players who stay on the defensive side of the field. Defenders focus on blocking an opponent's shot and work in conjunction with their team goalie. Midfielders are the players who play offense and defense and must be able to score against a goalie and run back to the middle of the field to play defense. There is one goalie for each team. The goalie is located in and outside the goal, with a main purpose of trying to stop opponents from scoring.

Regardless of position, all lacrosse players must be proficient in the art of feeding. Feeding is where a player "feeds," or passes the ball to, an attacker for a score, i.e., gets the lacrosse ball to the attacker. It is a type of assist for another player to score a goal. In addition, all players must learn how to hurl the lacrosse ball at varying speeds, distances and heights both for shots on goal and passes across the field. Thus, there exists a need for a practice device which can assist lacrosse players in becoming more effective feeders, scorers, and hurlers of lacrosse balls against other lacrosse players and the goalie, and which teaches players to work on the accuracy long clearing passes and how to take shots on goal at varying heights.

SUMMARY OF THE DISCLOSURE

The disclosure is a feeding net comprised of a backstop net affixed to a frame that is connected to a base, which may be mounted on casters or swivel wheels. In an exemplary embodiment, the net can be between 36 and 60 inches wide, and preferably 40, 48, 52 or 56 inches wise, and between about 40 and 96 inches in height, and preferably 60, 66, 68, 72, 84 or 96 inches in height. The frame can be metal, plastic or other suitable material. The base can be tub shaped to collect and hold lacrosse balls thrown at the net which do not enter one of the pockets provided thereon (discussed in detail below). The base can be stationary, or if desired, can sit atop locking casters or swivel wheels, such as wheels, 4, 6, 8 or 10 inches in diameter, for example. The wheeled base allows the feeding net to be moved from one location to another.

The net contains a plurality of drop pockets (e.g., anywhere from one to eight pockets, or even more), each having an open top to catch a lacrosse ball thrown at it. The nets can have similar or varying shapes and sizes, and can be placed wherever desired across a larger net that is attached to the frame of the device. The wheeled base can include a removable plastic drop bucket of suitable dimensions to substantially match the dimensions of the base, such as between 24 and 48 inches wide, and between 24 and 60 inches long, and between 4 and 18 inches deep, as desired. The drop bucket is able to retain lacrosse balls that are not caught inside the drop pocket or that bounce off the backstop net. The wheeled base can include an integral deflector shield situated across the backstop net. The deflector shields ensures that balls that bounce of the net can be deflected into the drop bucket.

BRIEF DESCRIPTION OF THE DRAWINGS

FIG. 1 is a perspective view of the feeding net.

DETAILED DESCRIPTION OF THE DRAWINGS

FIG. 1 shows an exemplary embodiment of a feeding net including a backstop net 20 affixed to a preferably metal frame 10. For this illustrated exemplary embodiment, the net measures 52 inches wide by 68 inches in height and has a metal frame, but the net can be provided having any suitable dimensions. The net 20 and the metal frame 10 can be of varying lengths depending on the size, age, and skill level of the player. The metal frame 10 is connected to a base 70 which in turn includes a plurality of swivel wheels 40, and preferably four swivel wheels, that can be selectively lockable, as desired. Each wheel 40 of the depicted embodiment measures 8 inches in diameter, though any suitable dimensions for the wheels is envisioned within the scope of the invention. The wheeled base 70 allows the feeding net device to be moved from one location to another. The depicted wheeled base is also made of metal. In another embodiment, the wheeled base can be made of plastic or other suitable material, as desired.

The depicted backstop net 20 includes four drop pockets 30 similar in configuration to a net found at the end of a lacrosse stick. While the depicted embodiment comprises four drop pockets 30, any number of drop pockets is envisioned, preferably between one and eight drop pockets. The drop pockets 30 are configured to catch lacrosse balls, and can be provided in any desired number and orientation, depending on the size of the net. The drop pockets 30 can be numbered with indicia, for example, from 1 to 4, as illustrated. This can allow a lacrosse coach to call out a specific number for a player to hurl a lacrosse ball at during a practice drill to enhance a player's skill at locating passes of a lacrosse ball to a desired location. If desired, the pockets can be named or color coded, as desired.

The wheeled base 70 preferably includes a removable drop bucket 50 within the parameters of the wheeled base 70. The drop bucket 50 is preferably made of plastic and preferably measures 30 inches in length by 23 inches in width by 10 inches in depth, but can be provided having any suitable dimensions and material. The drop bucket 50 is able to retain lacrosse balls that are not caught inside the drop pockets 30 that bounce off the backstop net 20. The wheeled base 70 preferably includes an integral deflector shield 60 which is located across the wheeled base from the backstop net 20. The deflector shield 60, having a net surrounded by a frame, ensures that any balls that bounce of the net 20 can be deflected into the drop bucket 50.

The feeding net can be used for attackers and midfielders to practice off of a dodge. Dodges are where players uses various moves to bypass opposing players in order to pass or score. Defensive players can utilize the feeding net in practicing long clearing passes. The feeding net can assist beginner players with their accuracy in passing off of a doge or in fielding a ground ball (i.e., a loose ball rolling on the lacrosse field). By wheeling the feeding net 20 to a distance further down the field, goalies can also practice their accuracy in blocking incoming balls. By setting the net at a distance in front of the goal and making the shooter (i.e. player) take a shot over the top of the net, the feeding net is assisting players in practicing their high to low shot.

The methods and systems of the disclosed embodiments, as described above and shown in the drawings, provide for equipment and related techniques with superior attributes including, among other things, improved ease of use. It will be apparent to those skilled in the art that various modifications and variations can be made in the devices and methods of the disclosed embodiments without departing from the spirit or scope of the disclosure. Thus, it is intended that the disclosed embodiments include modifications and variations that are within the scope of the appended claims and their equivalents.

What is claimed is:

1. A lacrosse practice feeding net, comprising:

a backstop net defining therein a plurality of drop pockets for receipt of one or more lacrosse balls therein, each drop pocket having a non-circular perimeter defined in a plane of the backstop net, the non-circular perimeter having overall dimensions that are substantially the same as a lacrosse head to help simulate a lacrosse head, the non-circular perimeter of each hole having a visual indicia to distinguish it from other drop pockets formed into the backstop net;

a frame, surrounding and supporting the backstop net; and a base connected to extending outwardly from a front of the frame below the backstop net, the base including:

a removable drop bucket removably disposed within a perimeter framework of the base configured to collect lacrosse balls not caught within one of the drop pockets, the removable drop bucket having a back edge adjacent a bottom edge of the backstop net, and a front edge disposed forward of the back edge;

a deflector shield extending upwardly and away from the backstop net from a location adjacent the front edge of the drop bucket, the deflector shield being configured to deflect a lacrosse ball into the drop bucket that has bounced off of the backstop net; and a plurality of wheels extending downwardly from the base to facilitate transport of the feeding net, wherein the drop pockets extend in a direction away from the deflector shield, so as to position the deflector shield between the backstop net and a user.

2. A lacrosse practice feeding net according to claim 1, wherein the number of drop pockets is between two and eight.

3. A lacrosse practice feeding net according to claim 2, wherein the number of drop pockets is four.

4. A lacrosse practice feeding net according to claim 1, wherein the frame is composed at least in part of metal.

5. A lacrosse practice feeding net according to claim 1, wherein the backstop net is about 50 inches wide by about 70 inches in height.

6. A lacrosse practice feeding net according to claim 1, wherein the plurality of wheels includes four wheels.

7. A lacrosse practice feeding net according to claim 1, wherein at least one of the wheels is selectively lockable.

8. A lacrosse practice feeding net according to claim 1, wherein the base is composed at least in part of metal.

9. A lacrosse practice feeding net according to claim 1, wherein the visual indicia includes naming.

10. A lacrosse practice feeding net according to claim 1, wherein the drop bucket is made at least in part from plastic.

11. A lacrosse practice feeding net according to claim 10, wherein the drop bucket has a length of about 30 inches, a width of about 24 inches, and a depth of about 10 inches.

12. A lacrosse practice feeding net according to claim 1, wherein the deflector shield includes a net surrounded by a frame.

13. A lacrosse practice feeding net according to claim 1, wherein the backstop net extends vertically upward from the base.

14. A lacrosse practice feeding net according to claim 1, wherein the visual indicia includes color coding.

* * * * *